United States Patent [19]

Russell et al.

[11] Patent Number: 4,507,958

[45] Date of Patent: Apr. 2, 1985

[54] SURVEYING OF A BOREHOLE FOR POSITION DETERMINATION

[75] Inventors: Anthony W. Russell; Michael K. Russell, both of Cheltenham, England

[73] Assignee: NL Sperry-Sun, Inc., Stafford, Tex.

[21] Appl. No.: 530,184

[22] Filed: Sep. 8, 1983

[30] Foreign Application Priority Data

Sep. 11, 1982 [GB] United Kingdom ..... 8225968

[51] Int. Cl.[3] ..... E21B 47/022

[52] U.S. Cl. ..... 73/151; 33/304; 364/422

[58] Field of Search ..... 73/151; 175/45; 33/304, 33/313, 316, 317 R; 364/422

[56] References Cited

U.S. PATENT DOCUMENTS

| | | | |
|---|---|---|---|
| 4,199,869 | 4/1980 | Van Steenwyk | 33/304 |
| 4,293,046 | 10/1981 | Van Steenwyk | 175/45 |
| 4,399,692 | 8/1983 | Hulsing et al. | 73/151 |
| 4,433,491 | 2/1984 | Ott et al. | 33/304 |
| 4,461,088 | 7/1984 | Van | 33/304 |

FOREIGN PATENT DOCUMENTS

| | | | |
|---|---|---|---|
| 2086055 | 5/1982 | United Kingdom | 33/304 |

*Primary Examiner*—Howard A. Birmiel

*Attorney, Agent, or Firm*—Carl O. McClenny; William E. Johnson, Jr.

[57] ABSTRACT

A borehole is surveyed by positioning at the mouth of the borehole a survey instrument having a casing and a three-axis rate gyroscope unit mounted within the casing, and sensing at least two components of gravity in at least two mutually transverse directions with respect to the survey instrument by means of a gravity sensor unit. The survey instrument is then moved along the borehole with the start and finish of the run being at the mouth of the borehole or at some known reference along the path of the borehole. During the run the rates of rotation about three non-coplanar axes are sensed at a series of locations along the length of the borehole by means of the rate gyroscope unit. The position of the borehole at each measuring location is then calculated by determining the initial set of direction cosines from the sensed gravity components and an assumed initial value of the azimuth angle and incrementing these values using the rates of rotation sensed by the rate gyroscope unit to obtain the sets of direction cosines at subsequent measuring locations.

12 Claims, 5 Drawing Figures

FIG.1
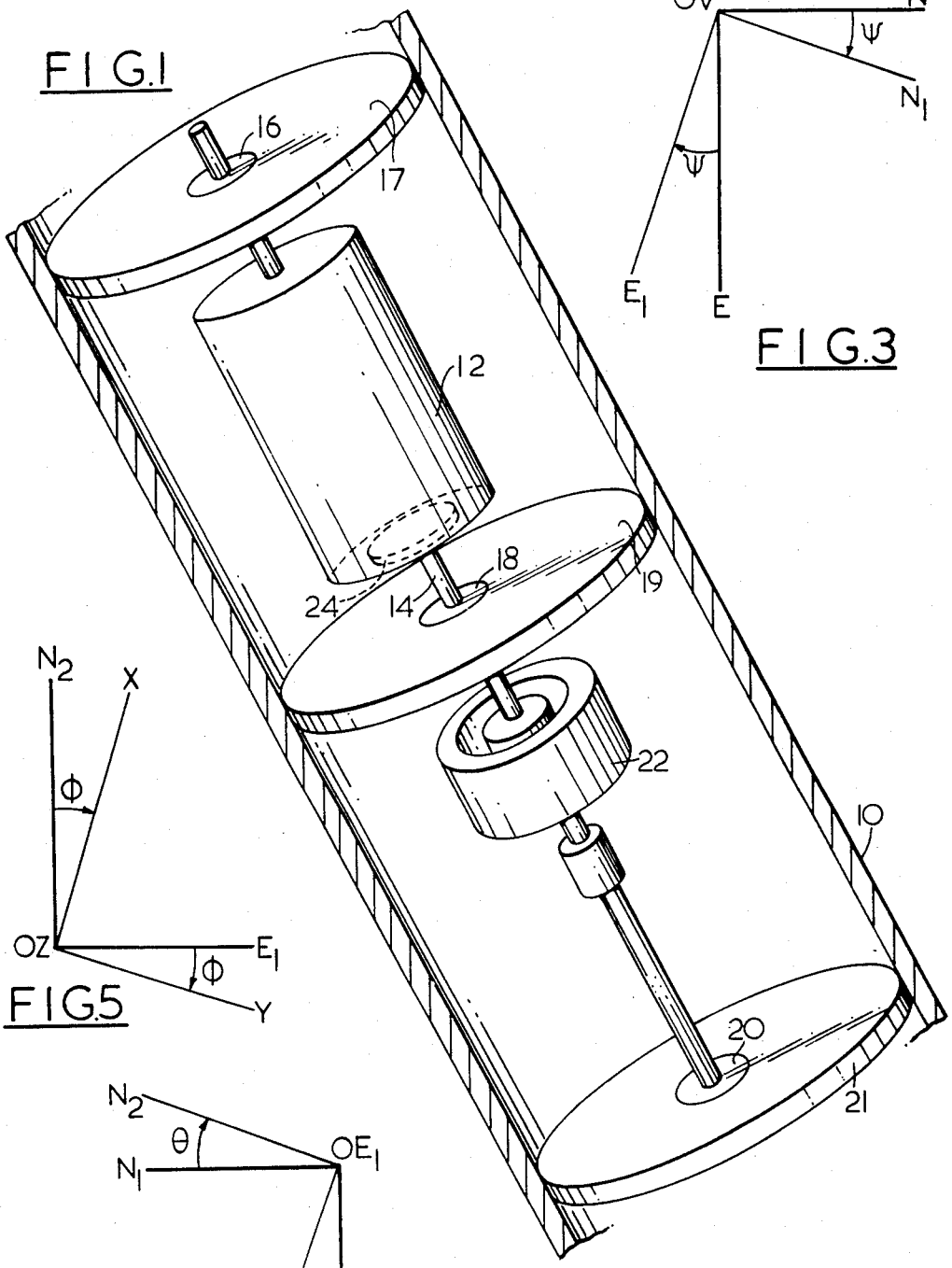
FIG.3
FIG5
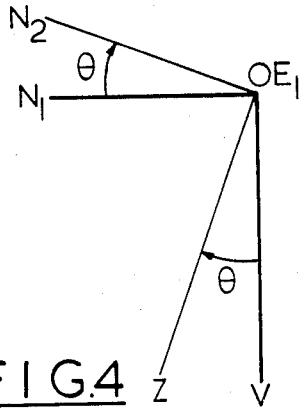
FIG.4

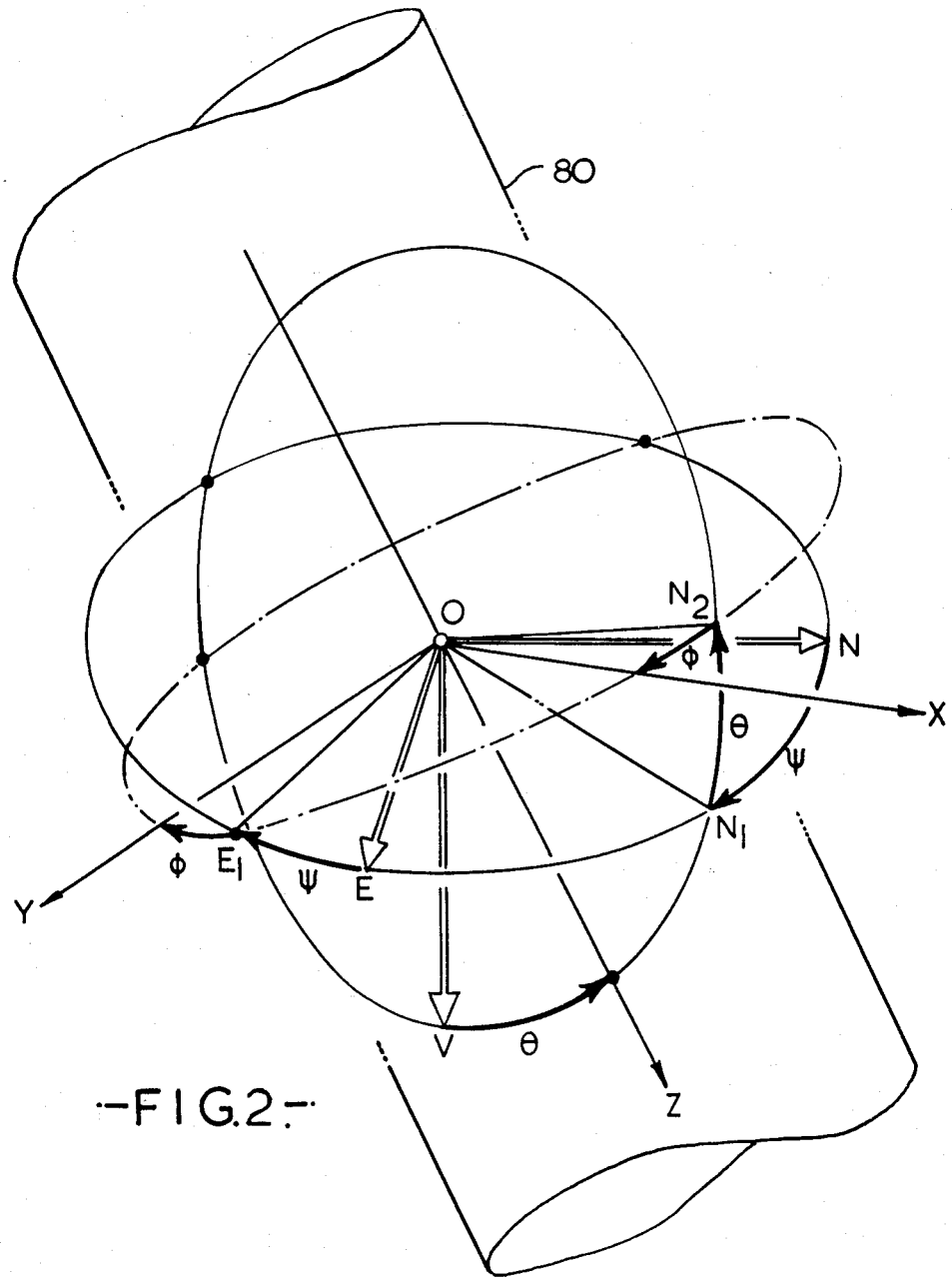
-FIG.2-

SURVEYING OF A BOREHOLE FOR POSITION DETERMINATION

BACKGROUND OF THE INVENTION

This invention relates to methods of, and apparatus for, surveying a borehole.

A spatial survey of the path of a borehole is usually derived from a series of values of the azimuth angle and the inclination angle taken along the length of the borehole. Measurements from which the values of these two angles can be derived are made at successive locations along the path of the borehole, the distances between adjacent locations being accurately known.

In a borehole in which the earth's magnetic field is unchanged by the presence of the borehole itself, measurements of the components of the earth's gravitational and magnetic fields in the direction of the casing-fixed axes can be used to obtain values for the azimuth angle and the inclination angle, the azimuth angle being measured with respect to an earth-fixed magnetic reference, for example magnetic North. However, in situations in which the earth's magnetic field is modified by the local conditions in a borehole, for example when the borehole is cased with a steel lining, magnetic measurements can no longer be used to determine the azimuth angle relative to an earth-fixed reference. In these circumstances, it is necessary to use a gyroscopic instrument.

Several gyroscopic instruments have been developed for this purpose and these have operated satisfactorily at inclination angles below a certain value. However, at inclination angles in excess of 60° to the vertical, increasingly less accurate surveys result as the inclination increases. The present invention provides an entirely new surveying technique which is capable of producing very accurate surveys at any inclination angle and which is particularly applicable to the use of gyroscopic units having no moving parts which are of high accuracy and reliability.

SUMMARY OF THE INVENTION

According to the invention, there is provided a method of surveying a borehole comprising positioning at the mouth of the borehole a survey instrument having a casing and a three-axis rate gyroscope unit mounted within the casing; sensing at least two components of gravity in at least two mutually transverse directions with respect to the survey instrument by means of a gravity sensor unit; moving the survey instrument along the borehole with the start and finish of the run being at the mouth of the borehole or at some known reference along the path of the borehole; sensing the rates of rotation about three non-coplanar axes at a series of locations along the length of the borehole by means of the rate gyroscope unit; and calculating the position of the borehole at each measuring location by determining an initial set of direction cosines from the gravity components sensed at the mouth of the borehole and an assumed initial value of the azimuth angle and incrementing these values using the rates of rotation sensed by the rate gyroscope unit to obtain the sets of direction cosines at subsequent measuring locations.

Preferably, in order to ensure that the results of the survey are consistent with the measurement axes of the rate gyroscope unit being aligned with the earth-fixed axes at the mouth of the borehole, regardless of the actual alignment of the instrument at the start of the run, the initial set of direction cosines is calculated for varying angles of initial azimuth and the subsequent incremental calculations are performed until the result is achieved that the summation of the calculated inertial rates of rotation of the instrument about an East/West direction over the length of the run is substantially equal to zero.

In one embodiment of the invention, the instrument comprises an elongate casing having its longitudinal axis coincident with the axis of the borehole during the survey, and the rate gyroscope unit is pivotally mounted within the casing with its pivot axis coincident with the longitudinal axis of the casing, and the rate gyroscope unit is rotated about its pivot axis in a controlled manner in order to minimise errors due to roll of the instrument during the survey.

The invention also provides apparatus for surveying a borehole, comprising an instrument casing, a gravity sensor unit adapted to sense at least two components of gravity in at least two mutually transverse directions with respect to instrument casing at the mouth of the borehole, a three-axis rate gyroscope unit mounted within the instrument casing and adapted to sense the rates of rotation about three non-coplanar axes at a series of locations as the instrument casing is traversed along the borehole, means for determining an initial set of direction cosines from the gravity components sensed at the mouth of the borehole and an assumed value of the azimuth angle, means for incrementing these values using the rates of rotation sensed by the rate gyroscope unit to obtain the sets of direction cosines at subsequent measuring locations, and means for determining the position of the borehole at each measuring location from the direction cosine sets.

The gyroscope unit preferably comprises three laser gyros each of which consists of a propagation medium, a laser source for transmitting two laser beams about a closed path in the propagation medium in opposite directions, and a photodetector for detecting the interference fringes where the two beams meet caused by doppler shifting of the frequencies of the beams due to rotation about the axis of the device and for providing a pulse output proportional to the integrated rate of rotation.

BRIEF DESCRIPTION OF THE DRAWINGS

In order that the invention may be more fully understood, a preferred embodiment of the invention will now be described, by way of example, with reference to the accompanying drawings, in which:

FIG. 1 is a schematic perspective view of the surveying instrument with its casing shown in section;

FIG. 2 is a schematic representation illustrating a transformation between two sets of reference axes; and FIGS. 3 to 5 are diagrams illustrating various stages of the transformation shown in FIG. 3.

DETAILED DESCRIPTION OF THE DRAWINGS

Referring to FIG. 1, the instrument comprises, within a casing 10 whose longitudinal axis is coincident with the bore axis in operation, a three-axis rate gyroscope package 12 mounted on a rotatable shaft 14 extending along the longitudinal axis of the casing 10 and provided with upper, intermediate and lower bearings 16, 18 and 20 supported by upper, intermediate and lower bearing mountings 17, 19 and 21. The gyroscope package 12 incorporates three rate gyros, for example laser gyros, having their measurement axes arranged respectively along the longitudinal axis of the casing (Z-axis) and two mutually orthogonal axes (X-axis and Y-axis) extending in a plane perpendicular to the longitudinal axis. The shaft 14 is also provided with a torque motor 22 adapted to rotate the shaft 14 within the casing 10 in response to an input signal. The instrument also incorporates a gravity sensor unit 24 comprising three accelerometers mounted on the shaft 14 with their measurement axes arranged parallel to the axes of the rate gyros. In a variation of this embodiment the gravity sensor unit 24 comprises only two accelerometers with their axes arranged along two mutually orthogonal directions.

FIG. 2 schematically illustrates a borehole 80 and various reference axes relative to which the orientation of the borehole 80 may be defined, these axes comprising a set of earth-fixed axes ON, OE and OV where OV is vertically down, ON is due North and OE is due East, and a set of casing-fixed axes OX, OY and OZ where OZ lies along the local direction of the borehole at a measuring station and OX and OY are in a plane perpendicular to this direction. The set of earth-fixed axes can be rotated into the set of casing-fixed axes by the following three clockwise rotations:

(1) rotation about the axis OV through the aximuth angle $\psi$ as shown in FIG. 3.

(2) rotation about the axis $OE_1$ through the inclination angle $\theta$ as shown in FIG. 4, and (3) rotation about the axis OZ through the high-side angle $\phi$ as shown in FIG. 5.

Vector transformation from the earth-fixed set of axes ON, OE and OV to the casing-fixed set of axes OX, OY and OZ can be represented by the matrix operator equation:

$$\overline{U}_{X,Y,Z} = \{\phi\}\,\{\theta\}\,\{\psi\} \cdot \overline{U}_{N,E,V}$$

$$\text{where } \{\psi\} = \begin{bmatrix} \cos\psi & \sin\psi & 0 \\ -\sin\psi & \cos\psi & 0 \\ 0 & 0 & 1 \end{bmatrix}$$

$$\{\theta\} = \begin{bmatrix} \cos\theta & 0 & -\sin\theta \\ 0 & 1 & 0 \\ \sin\theta & 0 & \cos\theta \end{bmatrix}$$

$$\{\phi\} = \begin{bmatrix} \cos\phi & \sin\phi & 0 \\ -\sin\phi & \cos\phi & 0 \\ 0 & 0 & 1 \end{bmatrix}$$

where $\overline{U}_X$, $\overline{U}_Y$ and $\overline{U}_Z$ are unit vectors in the casing-fixed axes directions OX, OY and OZ, $\overline{U}_N$, $\overline{U}_E$ and $\overline{U}_V$ are unit vectors in the earth-fixed axes directions ON, OE and OV.

This transformation may also be expressed in terms of the direction cosine sets $\{1_{x,y,z}, m_{x,y,z}, n_{x,y,z}\}$ for the unit vectors along the casing-fixed axes directions with respect to the earth-fixed axes directions as follows:

$$\begin{bmatrix} U_X \\ U_Y \\ U_Z \end{bmatrix} = \begin{bmatrix} l_x & m_x & n_x \\ l_y & m_y & n_y \\ l_z & m_z & n_z \end{bmatrix} \begin{bmatrix} U_N \\ U_E \\ U_V \end{bmatrix}$$

-continued $$\text{Thus} \begin{bmatrix} l_x & m_x & n_x \\ l_y & m_y & n_y \\ l_z & m_z & n_z \end{bmatrix} = \{\phi\}\,\{\theta\}\,\{\psi\}$$

Applying the operator to the earth's gravity vector $$\bar{g} \text{ yields} \begin{bmatrix} g_X \\ g_Y \\ g_Z \end{bmatrix} = \{\phi\}\,\{\theta\}\,\{\psi\} \begin{bmatrix} 0 \\ 0 \\ g \end{bmatrix}$$

$$\text{or } g_X = -\cos\phi \cdot \sin\theta \cdot g$$
$$g_Y = \sin\phi \cdot \sin\theta \cdot g$$
$$g_Z = \cos\theta \cdot g$$

where $g_X$, $g_Y$ and $g_Z$ are the components of gravity along the casing-fixed axes directions OX, OY and OZ.

It is conventional practice for the results of a borehole survey to be expressed in terms of a series of values of the azimuth angle $\psi$ and the inclination angle $\theta$ taken along the length of the borehole. However, it is also possible to express these results in terms of a series of cartesian co-ordinate values measured with respect to the earth-fixed axes ON, OE and OV with the origin O being disposed at the start of the run, that is at the well-head. The positional co-ordinates with respect to these axes are referred to respectively as latitude, departure and true vertical depth.

In the course of a survey run the instrument is traversed along the path of the borehole starting at the well-head and back again so that both the start and finish of the run are located at the origin of the positional co-ordinates of the borehole. At the start of the run, with the instrument disposed at the well-head, the components $g_{oX}$, $g_{oY}$ and $g_{oZ}$ of the earth's gravity vector $\bar{g}$ are measured by the accelerometers of the gravity sensor unit 24 and the measured values are recorded. During the course of the run the output pulses of the rate gyros, whose outputs are proportional to the integrated rates of rotation about the axes of the gyros, are counted and at successive intervals of time $\delta t$ of, for example, one second the count values $C_{MX}$, $C_{MY}$ and $C_{MZ}$ for the three gyros are signalled to recording means at the surface. Each position of the instrument at which the count values are signalled to the surface may be termed a survey station and the time $t=\Sigma\delta t$ and length of path traversed is recorded at the surface along with the count values $C_{MX}$, $C_{MY}$ and $C_{MZ}$.

These values may then be used to perform a series of calculations by means of suitable computation circuitry at the surface. Twenty-five separate calculations are performed in respect of each survey station other than the first survey station, and these calculations are performed using the measurement data obtained in respect of that station and the measurement data and calculated data obtained in respect of the preceding survey station, as well as the known tangential and radial components $\omega_{ET}$ and $\omega_{ER}$ of the earth's rate of rotation vector at the appropriate geographical latitude $\lambda$.

These calculations are as follows in respect of a station k:

1.

$$\omega_{EXk} = \omega_{ET} \cdot l_{x(k-1)} - \omega_{ER} \cdot n_{x(k-1)} \qquad \text{(a)}$$

$$\omega_{EYk}=\omega_{ET}\cdot l_{y(k-1)}-\omega_{ER}\cdot n_{y(k-1)} \quad \text{(b)}$$

$$\omega_{EZk}=\omega_{ET}\cdot l_{z(k-1)}-\omega_{ER}\cdot n_{z(k-1)} \quad \text{(c)}$$

$$\delta t_k=t_k-t_{k-1} \quad \text{(d)}$$

$$\delta r_{XCk}=(C_{MXk}-C_{MX(k-1)})-\omega_{EXk}\cdot\delta t_k \quad \text{(e)}$$

$$\delta r_{YCk}=(C_{MYk}-C_{MY(k-1)})-\omega_{EYk}\cdot\delta t_k \quad \text{(f)}$$

$$\delta r_{ZCk}=(C_{MZk}-C_{MZ(k-1)})-\omega_{EZk}\cdot\delta t_k \quad \text{(g)}$$

$$\delta l_{xk}=\delta r_{YCk}\cdot n_{x(k-1)}-\delta r_{ZCk}\cdot m_{x(k-1)} \quad \text{(h)}$$

$$\delta m_{xk}=\delta r_{ZCk}\cdot l_{x(k-1)}-\delta r_{XCk}\cdot n_{x(k-1)} \quad \text{(i)}$$

$$\delta n_{xk}=\delta r_{XCk}\cdot m_{x(k-1)}-\delta r_{YCk}\cdot l_{x(k-1)} \quad \text{(j)}$$

$$\delta l_{yk}=\delta r_{YCk}\cdot n_{y(k-1)}-\delta r_{ZCk}\cdot m_{y(k-1)} \quad \text{(k)}$$

$$\delta m_{yk}=\delta r_{ZCk}\cdot l_{y(k-1)}-\delta r_{XCk}\cdot n_{y(k-1)} \quad \text{(l)}$$

$$\delta n_{yk}=\delta r_{XCk}\cdot m_{y(k-1)}-\delta r_{YCk}\cdot l_{y(k-1)} \quad \text{(m)}$$

$$\delta 1_{zk}=\delta r_{YCk}\cdot n_{z(k-1)}-\delta r_{ZCk}\cdot m_{z(k-1)} \quad \text{(n)}$$

$$\delta m_{zk}=\delta r_{ZCk}\cdot l_{z(k-1)}-\delta r_{XCk}\cdot n_{z(k-1)} \quad \text{(o)}$$

$$\delta n_{zk}=\delta r_{XCk}\cdot m_{z(k-1)}-\delta r_{YCk}\cdot l_{z(k-1)} \quad \text{(p)}$$

$$l_{xk}=l_{x(k-1)}\cdot+\delta l_{xk} \quad \text{(q)}$$

$$m_{xk}=m_{x(k-1)}+\delta m_{xk} \quad \text{(r)}$$

$$n_{xk}=n_{x(k-1)}+\delta n_{xk} \quad \text{(s)}$$

$$l_{yk}=l_{y(k-1)}+\delta l_{yk} \quad \text{(t)}$$

$$m_{yk}=m_{y(k-1)}+\delta m_{yk} \quad \text{(u)}$$

$$n_{yk}=n_{y(k-1)}+\delta n_{yk} \quad \text{(v)}$$

$$l_{zk}=l_{z(k-1)}+\delta l_{zk} \quad \text{(w)}$$

$$m_{zk}=m_{z(k-1)}+\delta m_{zk} \quad \text{(x)}$$

$$n_{zk}=n_{z(k-1)}+\delta n_{zk} \quad \text{(y)}$$

In the above $\{C_{MXk}, C_{MYk}, C_{MZk}\}$ and $\{C_{MX(k-1)}, C_{MY(k-1)}, C_{MZ(k-1)}\}$ are the count values obtained at the station k and the preceding station k−1, $t_k$ and $t_{k-1}$ are the times at which the instrument was located at these stations, $\{l_{xk,yk,zk}, m_{xk,yk,zk}, n_{xk,yk,zk}\}$ and $\{l_{x(k-1),y(k-1),z(k-1)}, m_{x(k-1),y(k-1),z(k-1)}, n_{x(k-1),y(k-1),z(k-1)}\}$ are the direction cosine sets at these stations, and $\{\omega_{EXk},\omega_{EYk},\omega_{EZk}\}$ are the components of the earth's rate of rotation vector in the casing-fixed axes directions.

The following calculations are performed in respect of the first survey station using the measurement data obtained at that station:

2.

$$t_O=O \text{ (or known)} \quad \text{(a)}$$

$$S_O=O \text{ (or known)} \quad \text{(b)}$$

$$C_{MX}=C_{MY}=C_{MZ}=O \text{ (or known)} \quad \text{(c)}$$

$$l_{xO}=\cos\alpha \quad \text{(d)}$$

$$m_{xO}=\sin\alpha \quad \text{(e)}$$

$$n_{xO}=(-g_{oX})/g \quad \text{(f)}$$

$$l_{yO}=-\sin\alpha \quad \text{(g)}$$

$$m_{yO}=\cos\alpha \quad \text{(h)}$$

$$n_{yO}=(g_{oY})/g \quad \text{(i)}$$

$$l_{zO}=(-g_{oX}\cdot\cos\alpha+g_{oY}\cdot\sin\alpha)/g \quad \text{(j)}$$

$$m_{zO}=(-g_{oX}\cdot\sin\alpha-g_{oY}\cdot\cos\alpha)/g \quad \text{(k)}$$

$$n_{zO}=(g_{oZ})/g \quad \text{(l)}$$

where $\alpha$ is assigned an arbitrary value close to the value of the initial oritentation angle $(\phi+\psi)$ and $\{l_{xO,yO,zO}, m_{xO,yO,zO}, n_{xO,yO,zO}\}$ is the initial direction cosine set.

The initial direction cosine set should ideally be such that the casing-fixed axes lie along the directions of the earth-fixed axes and, thus, $$\begin{bmatrix} l_{x0} & m_{x0} & n_{x0} \\ l_{y0} & m_{y0} & n_{y0} \\ l_{z0} & m_{z0} & n_{z0} \end{bmatrix} = \begin{bmatrix} 1 & 0 & 0 \\ 0 & 1 & 0 \\ 0 & 0 & 1 \end{bmatrix}$$

In practice, the casing-fixed axes of the instrument are not aligned with the earth-fixed set at the start of the traverse and it is therefore necessary to determine the initial set of direction cosines. The three accelerometers with their measuring axes along the casing-fixed axes directions yield initial values for the components of the earth's gravity vector $\bar{g}$ and the initial direction cosine set can be represented by $$\begin{bmatrix} \cos\phi\cdot\cos\theta\cdot\cos\psi-\sin\phi\cdot\sin\psi & \cos\phi\cdot\cos\theta\cdot\sin\psi+\sin\phi\cdot\cos\psi & -\cos\phi\cdot\sin\theta \\ -\sin\phi\cdot\cos\theta\cdot\cos\psi-\cos\phi\cdot\sin\psi & -\sin\phi\cdot\cos\theta\cdot\sin\psi+\cos\phi\cdot\cos\psi & \sin\phi\cdot\sin\theta \\ \sin\theta\cdot\cos\psi & \sin\theta\cdot\sin\psi & \cos\theta \end{bmatrix}$$

where $\sin\theta = \{(g_{oX})^2 + (g_{oY})^2\}^{\frac{1}{2}}/g$ $\cos\theta = (g_{oZ})/g$ $\sin\phi = (g_{oY})/\{(g_{oX})^2 + (g_{oY})^2\}^{\frac{1}{2}}$ $\cos\phi = -(g_{oX})/\{(g_{oX})^2 + (g_{oY})^2\}^{\frac{1}{2}}$ where $g = \{(g_{oX})^2 + (g_{oY})^2 + (g_{oZ})^2\}^{\frac{1}{2}}$ The initial value of the azimuth $\psi$ is not a function of the initial values of the gravity components. The initial set of directional cosines are therefore computed for varying values of $\psi$ by means of the calculations set out at 2, and the incremental calculations set out at 1 above are performed for each such set together with the additional incremental summation:

$$I = \sum_{s,t} (m_x \cdot \delta C_{MX} + m_y \cdot \delta C_{MY} + m_z \cdot \delta C_{MZ})$$

This summation represents the integral $\int \omega_{M/OE} \cdot \delta t$ where $\omega_{M/OE}$ is the calculated apparent inertial rate of rotation of the instrument about the earth's OE direction.

The true inertial rate of rotation of the instrument about the OE direction can be represented by $$\omega_{I/OE} = \omega_{E/OE} + \omega_{S/OE}$$

where $\omega_{E/OE}$ is the earth's rate of rotation about OE and $\omega_{S/OE}$ is the rate of rotation of the instrument about OE due to the traverse of the path S.

Since $\omega_{E/OE}=0$ it follows that:

$$\int_S \omega_{I/OE} \cdot \delta t = \int_S \omega_{S/OE} \cdot \delta t$$

Furthermore, since the traverse start and finish points are the same:

$$\int_S \omega_{S/OE} \cdot \delta t = \int_{S/\text{In-Run}} \omega_{S/OE} \cdot \delta t + \int_{S/\text{Out-Run}} \omega_{S/OE} \cdot \delta t = 0$$

$$\text{Thus, } \int_S \omega_{I/OE} \cdot \delta t = 0$$

The calculations are performed with the angle $\psi$ varied until the summation I=O is obtained when the measured rate components will be equal to the calculated components of the true inertial rates for the path so determined.

The positional co-ordinates of the path of the borehole with respect to an earth-fixed set of axes with origin at the start and finish of the run are computed as:

$$\text{LATITUDE} = \sum_{s,t} \delta(\text{LAT})$$

$$\text{DEPARTURE} = \sum_{s,t} \delta(\text{DEP})$$

$$\text{TRUE VERTICAL DEPTH} = \sum_{s,t} \delta(\text{TVD})$$

where $\delta(\text{LAT}) = l_z \cdot \delta s$ $\delta(\text{DEP}) = m_z \cdot \delta s$ $\delta(\text{TVD}) = n_z \cdot \delta s$ The survey results may also be expressed in terms of a series of values of the azimuth angle $\psi$ and the inclination angle $\theta$ computed from these co-ordinates.

All the calculations described above are valid if the gryo-fixed set of axes is coincident with a casing-fixed set of axes. However, in practice, the instrument is preferably mechanized with the gyro-fixed Z-axis coincident with the longitudinal axis of the casing and with the gyro-fixed X-and Y-axes lying in a platform which can be controlled in roll about the OZ axis by means of the torque motor 22. The facility to control the roll of this platform about the OZ axis using as the control function the measured rate about this axis allows techniques to be used which minimize the scale factor error in $\omega_{MZ}$ and reduce errors due to the datum errors in $\omega_{MX}$ and $\omega_{MY}$.

In the above described survey method the gravity sensor unit comprising three accelerometers is mounted within the instrument casing and is traversed along the borehole with the survey instrument during the survey run. However, this requires the gravity sensor unit to be sufficiently small to fit within the casing and to be capable of withstanding the hostile conditions down-hole, particularly with regard to temperature. In an alternative embodiment in accordance with the invention, therefore, the gravity sensor unit is separate from the survey instrument and is used only for initial alignment reference at the surface but is not taken down the well. This method has some advantages since the separate gravity sensor unit does not need to conform to strict size and temperatures requirements, and the down-hole survey instrument will be rendered more rugged since there is no longer the necessity for a down-hole accelerometer package. Whichever method is used the accelerometers are used only for initial alignment (or in-hole reference alignment) purposes while the survey instrument is stationary within the earth-fixed frame of reference.

Theoretical Background

At time t the unit vector set in the casingfixed set of axes OX, OY and OZ is $(\overline{U}_X, \overline{U}_Y, \overline{U}_Z)$. This set rotates into a unit vector set having axes OX', OY' and OZ' after time $\delta t$ by means of a rotation $\overline{\omega} = \omega_X \cdot \overline{U}_X + \omega_Y \cdot \overline{U}_Y + \omega_Z \cdot \overline{U}_Z$. Thus a vector $\overline{V}$ in the rotating frame will become vector $\overline{V}'$ after time $\delta t$ due to the rotation of the frame only where $\overline{V}' = \overline{V} + \delta t \cdot (\overline{\omega} \times \overline{V})$.

If the direction cosine set for $\overline{V}$ with respect to the axes OX, OY and OZ is $(l,m,n)$ and the direction cosine set for $\overline{V}'$ with respect to the axes OX, OY and OZ is (l', m', n') then $$l' \cdot \overline{U}_x + m' \cdot \overline{U}_Y + n' \cdot \overline{U}_Z = l \cdot \overline{U}_X + m \cdot \overline{U}_Y + n \cdot \overline{U}_Z + (\delta r_X \cdot \overline{U}_X + \delta r_Y \cdot \overline{U}_Y + \delta r_Z \cdot \overline{U}_Z) \times (l \cdot \overline{U}_X + m \cdot \overline{U}_Y + n \cdot \overline{U}_Z)$$

where $\delta r_X = \omega_X \cdot \delta t$, $\delta r_Y = \omega_Y \cdot \delta t$, $\delta r_Z = \omega_Z \cdot \delta t$ Thus $l' - l = \delta l = \delta r_Y \cdot n - \delta r_Z \cdot m$ $m' - m = \delta m = \delta r_Z \cdot l - \delta r_X \cdot n$ $n' - n = \delta n = \delta r_X \cdot m - \delta r_Y \cdot l$ As described above in relation to the processing of the data obtained during a survey, incremental calculations are performed to continually update the values of the direction cosines of the unit vectors in the casing-fixed directions with respect to the earth-fixed axes ON, OE and OV:

$$l_{x,y,z} = \sum_{s,t} (\delta l_{x,y,z}) + l_{x0,y0,z0}$$

$$m_{x,y,z} = \sum_{s,t} (\delta m_{x,y,z}) + m_{x0,y0,z0}$$

$$n_{x,y,z} = \sum_{s,t} (\delta n_{x,y,z}) + n_{x0,y0,z0}$$

The incremental values corresponding to an incremental time change $\delta t$ and an incremental path length change $\delta s$ are calculated from $$\delta l_{x,y,z} = \delta r_{YC} \cdot n_{x,y,z} - \delta r_{ZC} \cdot m_{x,y,z}$$

-continued $$\delta m_{x,y,z} = \delta r_{ZC} \cdot l_{x,y,z} - \delta r_{XC} \cdot n_{x,y,z}$$

$$\delta n_{x,y,z} = \delta r_{XC} \cdot m_{x,y,z} - \delta r_{YC} \cdot l_{x,y,z}$$

where $$\delta r_{XC} = (\omega_{MX} - \omega_{EX}) \cdot \delta t = \delta C_{MX} - \delta C_{EX}$$

$$\delta r_{YC} = (\omega_{MY} - \omega_{EY}) \cdot \delta t = \delta C_{MY} - \delta C_{EY}$$

$$\delta r_{ZC} = (\omega_{MZ} - \omega_{EZ}) \cdot \delta t = \delta C_{MZ} - \delta C_{EZ}$$

We claim:

1. A method of surveying a borehole comprising positioning at the mouth of the borehole a survey instrument having a casing and a three-axis rate gyroscope unit mounted within the casing; sensing at least two components of gravity in at least two mutually transverse directions with respect to the survey instrument by means of a gravity sensor unit; moving the survey instrument along the borehole with the start and finish of the run being at the mouth of the borehole or at some known reference along the path of the borehole; sensing the rates of rotation about three non-coplanar axes at a series of locations along the length of the borehole by means of the rate gyroscope unit; and calculating the position of the borehole at each measuring location by determining an initial set of direction cosines from the gravity components sensed at the mouth of the borehole and an assumed initial value of the azimuth angle, and incrementing these values using the rates of rotation sensed by the rate gyroscope unit to obtain the sets of direction cosines at subsequent measuring locations.

2. A method according to claim 1, wherein, in order to ensure that the results of the survey are consistent with the measurement axes of the rate gyroscope unit being aligned with the earth-fixed axes at the mouth of the borehole, regardless of the actual alignment of the instrument at the start of the run, the initial set of direction cosines is calculated for varying angles of azimuth and the subsequent incremental calculations are performed until the result is achieved that the summation of the calculated inertial rates of rotation of the instrument about an East/West direction over the length of the run is substantially equal to zero.

3. A method according to claim 1, wherein the instrument comprises an elongate casing having its longitudinal axis coincident with the axis of the borehole during the survey, and the rate gyroscope unit is pivotally mounted within the casing with its pivot axis coincident with the longitudinal axis of the casing, and the rate gyroscope unit is rotated about its pivot axis in a controlled manner in order to minimise errors due to roll of the instrument during the survey.

4. A method according to claim 1, wherein the gravity sensor unit is mounted within the casing of the instrument and is moved along the borehole with the survey instrument during the survey.

5. A method according to claim 1, wherein the gravity sensor unit is separate from the survey instrument and is used to sense said components of gravity at the mouth of the borehole, but is not moved along the borehole with the survey instrument during the survey.

6. A method according to claim 1, wherein the results of the survey are expressed in terms of a series of coordinate values, termed latitude, departure and true vertical depth, measured with respect to the earth-fixed axes with the origin at the mouth of the borehole.

7. A method according to claim 1, wherein the results of the survey are expressed in terms of a series of values of the azimuth angle and the inclination angle.

8. Apparatus for surveying a borehole, comprising an instrument casing, a gravity sensor unit adapted to sense at least two components of gravity in at least two mutually transverse directions with respect to the instrument casing at the mouth of the borehole, a three-axis rate gyroscope unit mounted within the instrument casing and adapted to sense the rates of rotation about three non-coplanar axes at a series of locations as the instrument casing is traversed along the borehole, means for determining an initial set of direction cosines from the gravity components sensed at the mouth of the borehole and an assumed value of the azimuth angle, means for incrementing these values using the rates of rotation sensed by the rate gyroscope unit to obtain the sets of direction cosines at subsequent measuring locations, and means for determining the position of the borehole at each measuring location from the direction cosine sets.

9. Apparatus according to claim 8, wherein the rate gyroscope unit is pivotally mounted within the casing with its pivot axis coincident with a longitudinal axis of the casing, and torquing means are provided for rotating the rate gyroscope unit about its pivot axis in a controlled manner.

10. Apparatus according to claim 8, wherein the gravity sensor unit is mounted within the instrument casing so as to be movable along the borehole with the instrument casing during the survey.

11. Apparatus according to claim 8, wherein the gravity sensor unit is separate from the instrument casing and is not movable along the borehole with the instrument casing during the survey.

12. Apparatus according to claim 8, wherein the rate gyroscope unit comprises three laser gyros.

* * * * *